US005307861A

United States Patent [19]

Townsend

[11] Patent Number: 5,307,861

[45] Date of Patent: May 3, 1994

[54] BRUSH

[75] Inventor: Lloyd W. Townsend, New South Wales, Australia

[73] Assignees: John Lysaght (Australia) Limited, South Wales, Australia; Ishikawajima-Harima Heavy Industries Co., Ltd., Tokyo, Japan

[21] Appl. No.: 970,210

[22] Filed: Nov. 2, 1992

[30] Foreign Application Priority Data

Dec. 13, 1991 [AU] Australia ..... PK9995

[51] Int. Cl.[5] ..... B22D 11/06

[52] U.S. Cl. ..... 164/428; 15/256.51; 15/256.53

[58] Field of Search ..... 164/428, 480, 423, 463; 15/256.51, 256.53; 355/301

[56] References Cited

U.S. PATENT DOCUMENTS

| | | | |
|---|---|---|---|
| 3,153,800 | 10/1964 | Trotin | 15/207.2 |
| 3,343,195 | 9/1967 | Menges | 15/207.2 |
| 3,346,900 | 10/1967 | Stewart et al. | 15/207.2 |
| 3,613,143 | 10/1971 | Muhler et al. | 15/207.2 |
| 4,104,759 | 8/1978 | Odhner . | |
| 4,240,452 | 12/1980 | Jean . | |
| 4,346,492 | 8/1982 | Solow . | |
| 4,367,691 | 1/1983 | Bergs | 15/256.31 |
| 4,537,130 | 8/1985 | Theilacker | 15/256.51 |
| 4,592,594 | 6/1986 | d'Argembeau | 15/207.2 |
| 4,633,542 | 1/1987 | Taravel . | |
| 4,694,844 | 9/1987 | Berl et al. . | |
| 4,708,194 | 11/1987 | Mohn | 164/423 |
| 4,793,400 | 12/1988 | Wood | 164/423 |
| 4,811,780 | 3/1989 | Yamauchi et al. | 164/428 |
| 4,887,662 | 12/1989 | Tanaka et al. | 164/428 |
| 4,906,335 | 3/1990 | Goodnow et al. | 15/256.51 |
| 4,953,252 | 9/1990 | Akisawa | 15/256.51 |
| 4,972,780 | 11/1990 | Gasparrini et al. | 15/256.51 |

FOREIGN PATENT DOCUMENTS

| | | | |
|---|---|---|---|
| 72897 | 10/1991 | Australia . | |
| 504893 | 9/1992 | European Pat. Off. . | |
| 0083341 | 3/1989 | Japan | 164/480 |
| 0083343 | 3/1989 | Japan | 164/480 |
| 0099243 | 4/1990 | Japan | 164/480 |
| 0077748 | 4/1991 | Japan | 164/428 |
| 726209 | 3/1955 | United Kingdom . | |

*Primary Examiner*—Paula A. Bradley
*Assistant Examiner*—Erik R. Puknys
*Attorney, Agent, or Firm*—Nikaido, Marmelstein Murray & Oram

[57] ABSTRACT

A roll cleaning brush (21) for application to a rotating roll (12) includes an elongate brush element holder (24), a plurality of brush elements (25) each including a brush element base (26) and brush bristles (27) projecting from the base (26). Brush elements (25) are held by the brush element holder (24) in an array extending along the holder so that the bristles (27) form a substantially continuous brush tip for application to a roll to be cleaned but so that the brush elements are independently movable transversely of the holder to allow the tip to vary in shape to conform to the roll surface to be cleaned. Brush element holder (24) is formed with a longitudinally extending open mouthed channel (28), and brush element bases (26) are captive within the channel such that the bristles project from the mouth of the channel but are movable toward and away from the open mouth of the channel. An elongate resiliently compressible pneumatic tube (31) extends along the root of the channel (28) between the brush element bases (26) and the holder (24) to bias the brush element bases (26) toward the mouth of the channel (28).

10 Claims, 2 Drawing Sheets

BRUSH

FIELD OF THE INVENTION

This invention provides a novel kind of brush for the purpose of cleaning a rotating roll by being held against the roll. The brush according to the invention has particular, but not exclusive, application to the cleaning of hot metal casting rolls.

BACKGROUND OF THE INVENTION

It is known to use twin roll casters for continuous casting of metal strip. In a twin roll casting process hot metal is introduced between a pair of contrarotated horizontal casting rolls which are cooled so that metal shells solidify on the moving roll surfaces and are brought together at the nip between them to produce a solidified strip product at the outlet from the roll nip. The hot metal may be introduced into the nip between the rolls via a tundish and a metal delivery nozzle located beneath the tundish so as to receive a flow of metal from the tundish and to direct it into the nip between the rolls.

In order to prevent accumulation of metal oxides and slags or other contaminants on the roll surfaces, cleaning devices such as brushes or cleaning belts may be applied to the outer longitudinal sides of the rolls so that the roll surfaces are continuously cleaned before moving into contact with the molten metal in advance of the nip. One apparatus of this kind is disclosed in Japanese Patent Publication J03230849-A of Nippon Steel Corporation and Mitsubishi Heavy Industries KK. In this apparatus two sets of divided roller brushes are applied to the peripheral surface of each chilled casting roll with the brushes of one set being staggered with respect to those of the other set to provide a brushing action across the complete width of the casting roll. Japanese Patent Publication J63207450-A also of Nippon Steel Corporation and Mitsubishi Heavy Industries KK also discloses a twin roll caster in which the casting rollers are cleaned by roller brushes.

Problems in maintaining adequate contact between cleaning roller brushes or belts and the chilled casting rollers can arise due to thermal expansion and contraction of the rolls during the casting process which can result in a change to the shape of the roll surface. More particularly, an initially cylindrical roll may become noncylindrical so as to have a concave curvature or alternatively a convex or hogged configuration. The result is that the cleaner cannot be applied to the roll with even pressure throughout its length and may even lose contact with some parts of the roll surface, leading to an impaired cleaning action. The brush of the present invention enables this problem to be substantially overcome.

DISCLOSURE OF THE INVENTION

According to the invention there is provided a roll cleaning brush for application to a rotating roll and comprising an elongate brush element holder, a plurality of brush elements each comprising a brush element base and brush bristles projecting from the base which brush elements are held by the brush element holder in an array extending along the holder so that the bristles form a substantially continuous brush tip for application to a roll to be cleaned but so that the brush elements are independently movable transversely of the holder to allow the tip to vary in shape to conform to the roll surface to be cleaned.

Preferably the brush further comprises biasing means acting between the holder and the brush elements to bias the brush elements toward positions in which the brush tip is substantially straight.

Preferably further, the brush element holder is formed with a longitudinally extending open mouthed channel, the brush element bases are captive within the channel such that the bristles project from the mouth of the channel but are movable toward and away from the open mouth of the channel, and the biasing means comprises an elongate resiliently compressible element extending along the root of the channel between the brush element bases and the holder to bias the brush element bases toward the mouth of the channel. The resiliently compressible element may be a hollow pneumatic tube.

The channel mouth may have inturned edge flanges to retain the brush bases captive in the channel and to serve as stops against which the bases of the brush elements are biased by the compressible biasing element when the brush is in a free state.

The bristles of the brush elements may be wire bristles.

The invention also extends to apparatus for casting metal strip, comprising a pair of parallel casting rolls forming a nip between them, a metal delivery nozzle for delivery of molten metal into the nip between the casting rolls, and a pair of cleaning brushes of the above defined kind disposed to engage the rolls at locations spaced circumferentially of the rolls from the nip.

BRIEF DESCRIPTION OF THE DRAWINGS

In order that the invention may be more fully explained one particular embodiment will be described in some detail with reference to the accompanying drawings in which:-

BEST MODE OF CARRYING OUT THE INVENTION

Figure 1:
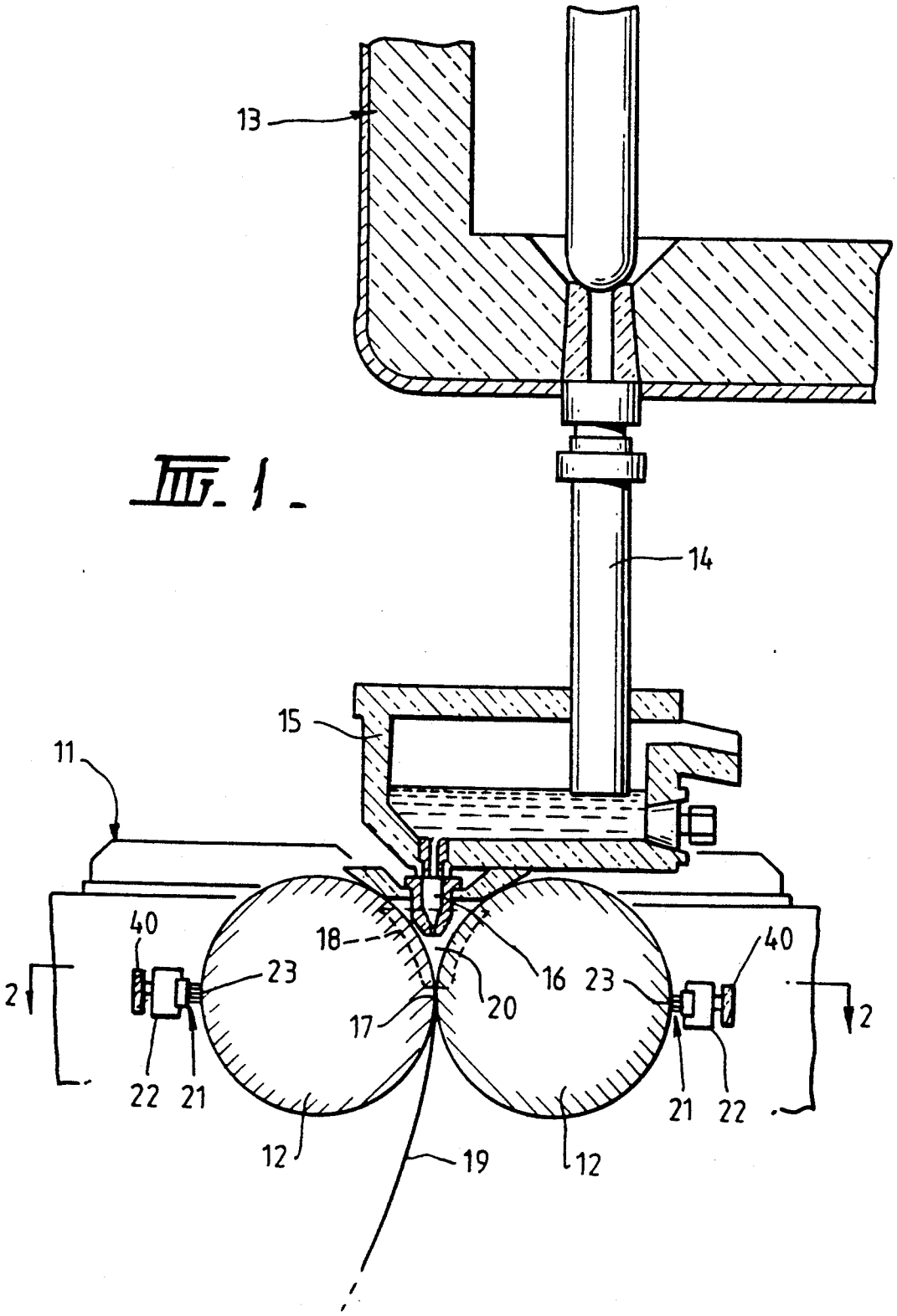
FIG. 1 illustrates a twin roll caster incorporating a pair of brushes in accordance with the present invention.

The illustrated twin roll caster comprises a main machine frame 11 which supports a pair of parallel casting rolls 12. Molten metal is supplied during a casting operation from a ladle 13 through a refractory ladle outlet shroud 14 to a tundish 15 and thence through a metal delivery nozzle 16 into the nip 17 between the casting rolls 12. Hot metal thus delivered to the nip 17 forms a pool 20 above the nip and this pool is confined at the end of the rolls by a pair of side closure plates 18 which are held against stepped ends of the rolls by actuation of a pair of hydraulic cylinder units (not shown). The upper surface of pool 20 (generally referred to as the "meniscus" level may rise above the lower end of the delivery nozzle so that the lower end of the delivery nozzle is immersed within this pool.

Casting rolls 12 are water cooled so that shells solidify on the moving roller surfaces and are brought together at the nip 17 between them to produce a solidified strip product 19 at the roll outlet. This product may be fed to a standard coiler (not shown).

The illustrated twin roll caster as thus far described is o the kind which is illustrated and described in some detail in our published Australian Patent Specification 72897/91 and reference may be made to that specification for appropriate constructional details which form no part of the present invention.

In accordance with the present invention the illustrated twin roll caster is provided with a pair of elongate roll cleaning brushes denoted generally as 21 mounted on structures 22 so as to engage the casting rolls 12 at locations 23 spaced circumferentially of the rolls from the nip 17. More specifically cleaning brushes 21 may engage the outer side extremities of rolls 12 to opposite sides of nip 17. The brush mounting structures 22 are connected to crank oscillators 40 which can be driven by hydraulic motors 41 so that the brushes can be oscillated longitudinally while maintaining engagement with the rolls 12.

Figure 2:
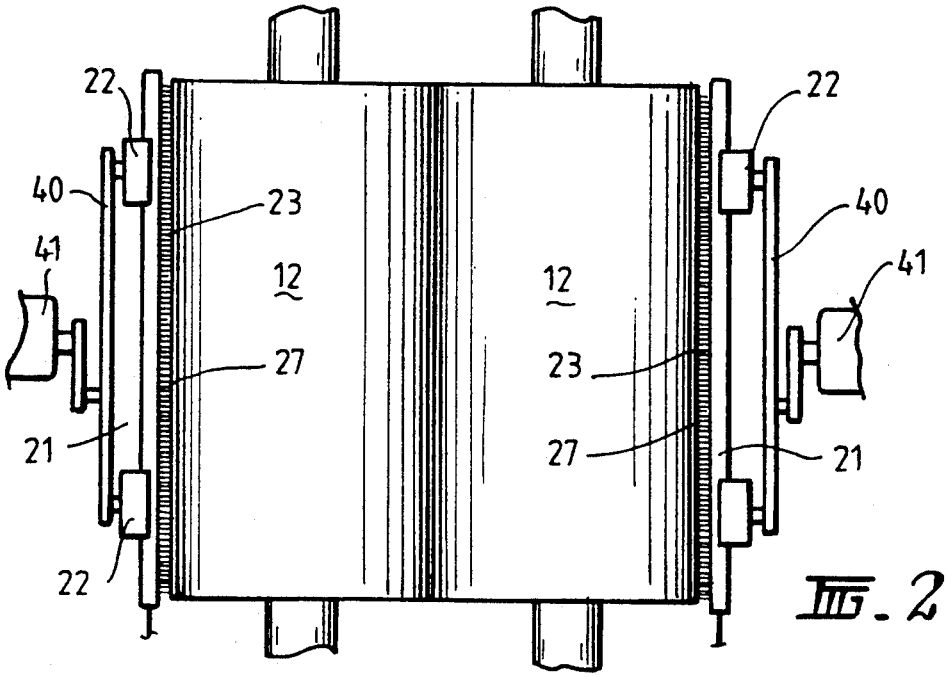
FIG. 2 is a substantially horizontal cross-section on the line 2—2 in FIG. 1.
Figure 3:
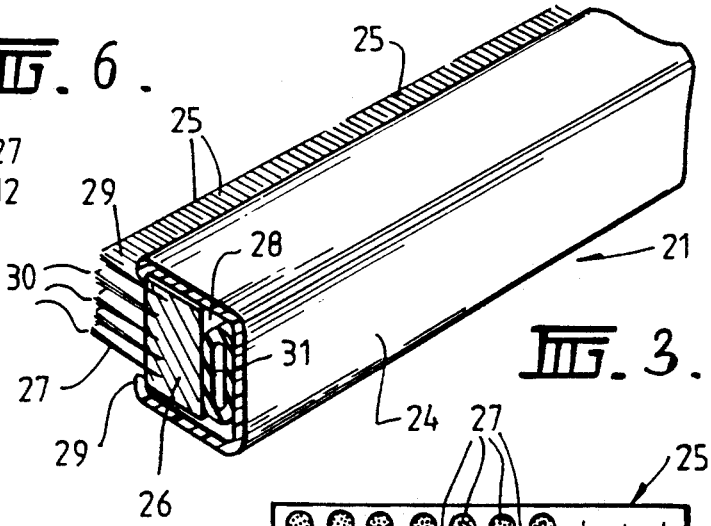
FIG. 3 is a diagrammatic perspective view of part of one of the cleaning brushes.
Figure 4:
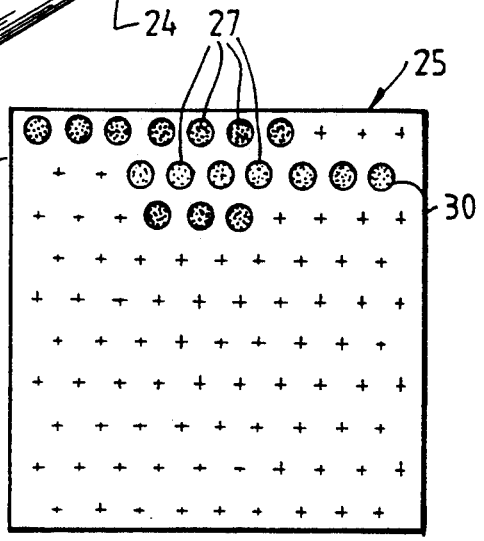
FIG. 4 illustrates a detail of the brush construction.

As most clearly seen in FIGS. 2 to 4, each roll cleaner comprises an elongated brush element holder 24 which holds a plurality of brush elements 25. Each brush element comprises a brush element base 26 and a set of brush bristles 27 projecting from the base 26. The bristles may be stiff wire bristles and may, for example be made of steel wire. Bases 26 may be found as rectangular blocks of any suitable material such as wood, plastics, ceramics or metal. The blocks may each be about 30 mm square and they may be arranged end to end throughout the length of the holder which may typically be about 840 mm long.

As illustrated in FIG. 4, bristles 27 may be grouped into clumps or tufts 30 spaced in parallel rows with the tufts of one row being staggered relative to the tufts of an adjacent row. The bristles of the successive longitudinal rows of tufts may be alternately coarse and fine. For example the tufts in alternate rows may comprise steel wires of 0.15 mm diameter whereas the tufts in the intermediate rows may be wires of 0.25 mm diameter, the tufts of all rows being about 3.0 mm diameter at the base and being spaced apart by about 3.0 to 3.5 mm in both the longitudinal and transverse directions. The bristles may project about 30 mm from the bases and may be set about 15 mm into the bases.

The holder 24 of each brush is comprised of a length of a substantially C-section metal strip so that it is formed with a longitudinal extending open mouthed channel 28. The mouth of the channel has inturned edge flanges 29 which retain the brush element bases 26 captive within the channel and which serves as stops against which the bases of the brush elements are biased by a compressible biasing element 31 in the form of an elongate, hollow pneumatic tube extending along the root of the channel between the brush element bases and the holder to bias the brush element bases toward the mouth of the channel. Pneumatic tube 31 may be formed of rubber or plastics material and may be provided with a pneumatic connector to enable it to be connected to a reservoir or other source of compressed air so that it will act to bias the brush elements toward to open mouth of the channel with a substantially constant biasing force while permitting transverse movements of the brush elements within the holder channel.

Figure 5:
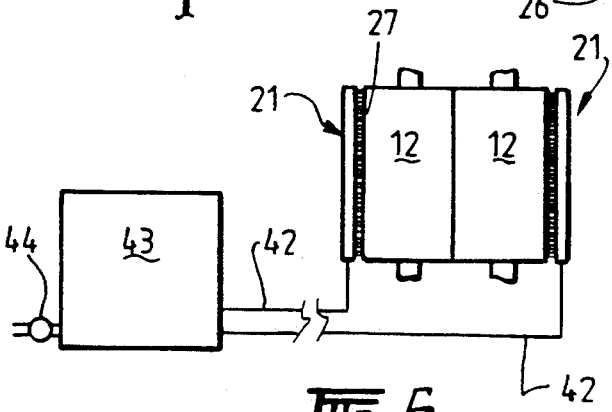
FIG. 5 shows how pneumatic tubes in the brushes are connected to a common air supply tank.

FIG. 5 illustrates how the pneumatic tubes 31 of the two cleaning brushes may be connected by connecting tubes 42 to a common supply tank 43. The supply tank may be pressurised through an inlet 44 to a pressure of 20 to 25 kpa and provides a sufficient volume to smooth out and minimise pressure variations in the pneumatic tubes 31 during operation of the brushes.

Figure 6:
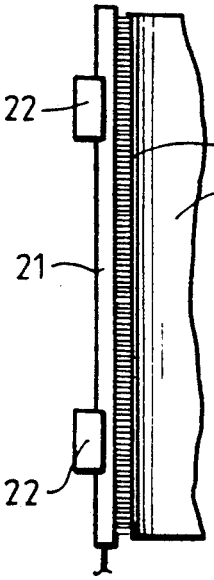
FIG. 6 illustrates the manner in which each brush can accommodate and adapt to changes in the roll profile.

When brushes 21 are in a free state the brush elements of each brush are biased by the tubes 31 against the mouth edge flanges 29 of the holders 24. The brush elements of each brush are thus held in a longitudinal array in which their bristles 27 form a substantially continuous brush tip for application to a roll to be cleaned so that the brush elements are independently movable transversely of the holder to allow the tip to vary in shape to conform to the roll surface to be cleaned. The brushes are mounted via structures 22 in such positions that their brush tips engage the rolls 12 to cause retraction of the brush elements back into the holder channels against the action of biasing tubes 31 so that the brush elements are all biased or loaded against the respective roll with a substantially constant loading pressure determined by the pneumatic pressure within tube 31 and can move back and forth within the channel to accommodate changes in the roll profile which may develop due to thermal expansion and contraction during a metal casting run while maintaining the substantially constant loading of all of the brush elements along the length of the brush. FIG. 6 illustrates to an exaggerated scale a manner in which the rolls 12 may adopt a convexly curved or hogged profile on thermal expansion in the manner in which the brush elements of the respective brush 21 can move within the brush holder to accommodate this profile variation.

The longitudinal oscillations of the brushes generated by oscillators 40 enhances the cleaning action and ensures that the bristles make contact with the rolls 12 across their complete width. The mixture of coarse and fine bristles also enhances the cleaning action since the coarse bristles can generate strong dislodging forces on the exposed contaminants whereas the fine bristles can penetrate small hollows and cavities in the roll surface which accumulate fine contaminating material.

The illustrated brush construction has enabled much improved cleaning of rolls in a twin roll caster to produce ferrous metal strip. However brushes produced in accordance with the invention are not limited to this particular application and may be employed in any machinery where a rotating roll is to be continuously clean by engagement with a cleaning brush. Moreover the details of the illustrated brush construction are given by way of example only and it is to be understood that many modifications and variations will fall within the scope of the appended claims.

I claim:

1. A roll cleaning brush for application to a rotating roll comprising:

an elongate brush element holder formed with a longitudinally extending open-mouthed channel;

a plurality of brush elements, each brush element including a brush element base and tufts of brush bristles projecting from the base in a series of parallel rows extending longitudinally of the brush and spaced apart across the brush with the tufts of successive rows staggered with respect to one another longitudinally of the brush, the brush elements held captive within the channel of by the brush element holder in an array extending along the brush element holder so that the tufts of bristles project from a mouth of the channel but are movable toward and away from the open mouth of the channel and the tufts of bristles form a substantially continuous brush tip for application to a roll to be cleaned but so that the brush elements are independently movable transversely of the brush element holder to allow the brush tip to vary in shape substantially continuously throughout its length to conform during operation to the roll surface to be cleaned; and biasing means, acting continuously between the holder and the brush elements, to bias the brush elements toward positions in which the brush tip is substantially straight, said biasing means including an elongate resilient compressible element extending along a root of the channel between the brush element bases and the holder to bias the brush element bases toward the mouth of the channel.

2. A brush as claimed in claim 1, wherein the resiliently compressible element is a hollow pneumatic tube.

3. A brush as claimed in claim 2, wherein the interior of the hollow pneumatic tube is connected to a reservoir of compressed air.

4. A brush as claimed in claim 1, wherein the channel mouth has inturned edge flanges to retain the brush bases captive in the channel and to serve as stops against which the bases of the brush elements are biased by the compressible biasing element when the brush is in a free state.

5. A brush as claimed in claim 1, wherein the bristles of the brush elements are wire bristles.

6. A brush as claimed in claim 1, wherein the rows of tufts of each brush element comprise rows in which the tufts are formed by relatively fine bristles and other rows in which the tufts are formed by coarser bristles.

7. A brush as claimed in claim 6, wherein the bristles of successive longitudinal rows of tufts are alternately coarse and fine.

8. A roll cleaning brush for application to a rotating roll comprising:

an elongate brush element holder;

a plurality of brush elements each including a brush element base and brush bristles projecting from the base, said brush elements being held by the brush element holder in an array extending along the brush element holder so that the bristles form a substantially continuous brush tip for application to a roll to be cleaned but so that the brush elements are independently movable transversely of the brush element holder to allow the brush tip to continuously vary in shape during operation to conform to the roll surface to be cleaned; and a resiliently compressible hollow pneumatic tube extending along the brush element holder and acting between the brush element bases and the holder, said resiliently compressible hollow pneumatic tube continuously biasing the brush elements toward positions in which the brush tip is substantially straight.

9. A brush as claimed in claim 8, wherein the interior of the hollow pneumatic tube is connected to a reservoir of compressed air to maintain a substantially constant pressure within the tube throughout movements of the brush elements relative to the holder.

10. Apparatus for casting metal strip, comprising a pair of parallel casting rolls forming a nip between them, a metal delivery nozzle for delivery of molten metal into the nip between the casting rolls to form a casting pool of molten metal in the nip, and a pair of cleaning brushes, and disposed to engage the rolls at locations spaced circumferentially of the rolls from the nip, each cleaning brush comprising:

an elongate brush element holder;

a plurality of brush elements each including a brush element base and brush bristles projecting from the base, said brush elements being held by the brush element holder in an array extending along the brush element holder so that the bristles form a substantially continuous brush tip for application to a roll to be cleaned but so that the brush elements are independently movable transversely of the brush element holder to allow the brush tip to continuously vary in shape during operation to conform to the roll surface to be cleaned; and a resiliently compressible hollow pneumatic tube extending along the brush element holder and acting between the brush element bases and the holder, said resiliently compressible hollow pneumatic tube continuously biasing the brush elements toward positions in which the brush tip is substantially straight.

* * * * *